United States Patent [19]

Rauchfuss, Jr.

[11] 4,305,680

[45] Dec. 15, 1981

[54] ROADWAY JOINT AND SEAL AND METHOD OF FABRICATING SAME

[75] Inventor: Arthur A. Rauchfuss, Jr., Patterson, N.C.

[73] Assignee: Old North Manufacturing Co., Inc., Lenoir, N.C.

[21] Appl. No.: 99,462

[22] Filed: Dec. 3, 1979

[51] Int. Cl.[3] ..... E01C 11/04

[52] U.S. Cl. ..... 404/69; 404/74; 52/396; 49/475

[58] Field of Search ..... 404/74, 47, 72, 48, 404/64, 65, 68, 69; 52/396; 49/475

[56] References Cited

U.S. PATENT DOCUMENTS

| | | | |
|---|---|---|---|
| 2,071,299 | 2/1937 | Gammeter | 404/49 |
| 2,111,113 | 3/1938 | Fischer | 404/66 X |
| 2,156,681 | 5/1939 | Dewhirst | 404/65 |
| 2,631,563 | 3/1953 | Perry | 118/72 |
| 2,666,979 | 1/1954 | Van Dusen | 29/148.2 |
| 3,255,680 | 6/1966 | Cooper | 404/74 |
| 3,276,335 | 10/1966 | Middlestadt | 404/48 |
| 3,360,273 | 12/1967 | Hundt | 277/34 |
| 3,368,463 | 2/1968 | Jones | 404/47 X |
| 3,524,390 | 8/1970 | Dill | 404/74 |
| 3,722,379 | 3/1973 | Koester | 404/74 X |
| 3,813,180 | 5/1974 | O'Brill | 404/48 |
| 3,887,292 | 6/1975 | Koster | 404/69 |
| 3,994,609 | 11/1976 | Puccio | 404/69 |
| 4,067,660 | 1/1978 | Puccio | 404/69 |
| 4,148,167 | 4/1979 | Puccio | 404/65 X |

FOREIGN PATENT DOCUMENTS

| | | | |
|---|---|---|---|
| 586790 | 4/1977 | Switzerland | 404/64 |

*Primary Examiner*—Nile C. Byers, Jr.
*Attorney, Agent, or Firm*—Bell, Seltzer, Park & Gibson

[57] ABSTRACT

A roadway expansion joint and seal is provided which comprises a pair of parallel metal side rails having a flexible membrane secured therebetween. The membrane includes enlarged opposite side edge portions which are mounted within respective C-shaped sockets in the side rails, and the side edge portions of the membrane each include a cavity which permits the side edges to be assembled in the sockets by initially compressing each side edge portion so as to collapse the cavity, while laterally forcing the same into the socket. Once in position, a relatively incompressible material is injected into the cavities of the side edge portions so as to substantially fill the cavities and thereby resist the withdrawal of the side edge portions from the sockets.

9 Claims, 4 Drawing Figures

ROADWAY JOINT AND SEAL AND METHOD OF FABRICATING SAME

The present invention relates to a roadway expansion joint which is adapted to span and seal the expansion gap between adjacent roadway sections in bridges, parking decks, overpasses, and other elevated roadways or the like.

It is well recognized that elevated roadways are not static, but move with respect to their foundations as a result of a number of conditions, including temperature changes, the passage of traffic, or the uneven settling of the foundation. To compensate for this relative movement, such roadways are constructed in sections which are independently supported for relative movement and whose adjacent edges are spaced apart to thereby define a gap between the sections which provides for such relative movement because of expansion or contraction of the sections or of other factors. These gaps are commonly referred to as "expansion gaps" and commonly extend transversely across the roadway, but in the case of multilane elevated highways or the like, it is common for one or more gaps also to extend in the direction of traffic flow.

Various expansion joint structures have been proposed for the purpose of providing a substantially uninterrupted road surface across these gaps, and to prevent water or debris from falling through the gaps onto underlying structures. One such expansion joint structure comprises a pair of longitudinally extending metal side rails mounted along the respective top side edges of the adjacent roadways sections, and with an elongate flexible membrane mounted between the rails to close or span the gap. To interconnect the rails and membrane, there is provided a socket of generally C-shaped cross-sectional configuration formed in each of the opposing faces of the rails, and the membrane includes enlarged hollow, opposite side edge portions which are mounted within respective ones of the C-shaped sockets. The membrane is assembled to the rails by initially applying a lubricating adhesive to the edges of the membrane and to the sockets of the metal rails, and then laterally forcing the edges into the sockets of the rails. The fact that the side edge portions are hollow permits the same to collapse and pass through the narrow entrance portion of the socket. Once in the socket, each side edge portion expands to its original configuration to substantially fully occupy the socket and such that each edge portion is retained behind the narrow entrance portion thereof.

A common problem associated with joints of the above type is the fact that small rocks or other objects often fall between the rails, and upon being run over by a passing vehicle, the object is pressed downwardly to pull a portion of the membrane side edge laterally from the socket of a supporting rail. Thus the seal is broken and the joint is essentially destroyed. Separation also can result from relative movement of the roadway sections beyond design limits, resulting for example from an unexpected foundation shift.

It is accordingly an object of the present invention to provide a roadway joint and seal of the described type which more effectively resists the separation of the membrane from its supporting rails.

It is a more particular object of the present invention to provide a simple and inexpensive method for effectively securing the membrane to its supporting rails in a roadway expansion joint structure of the described type.

These and other objects and advantages of the present invention are achieved in the embodiment illustrated herein by the provision of a roadway expansion joint and seal which comprises a pair of parallel, laterally spaced apart side rails, with the rails having opposed faces and a socket of generally C-shaped cross-sectional configuration formed in each of the opposing faces and extending along the length of the rail. An elongate flexible membrane extends longitudinally between the rails and has enlarged opposite side edge portions which are mounted within respective ones of the C-shaped sockets of the rails. The side edge portions of the membrane each have an internal cavity extending longitudinally along its length and positioned within the associated socket, and, once the side edge portion is positioned in the socket, the cavity is substantially filled with a relatively incompressible material, to thereby substantially resist the compression of the side edge portions and thus the withdrawal thereof from the respective sockets.

In accordance with the method aspects of the invention, the roadway expansion joint and seal as defined above is fabricated by a method which includes the steps of initially assembling the membrane between the rails, with the side edge portions of the membrane positioned within the C-shaped sockets, and then injecting a relatively incompressible material into the cavities of the side edge portions so as to substantially fill the cavities. In certain installations, injection into the cavities may be accomplished from the ends of the membrane. However, in the preferred embodiment, the incompressible material is injected into the cavities by piercing the wall of the cavities at spaced locations along the length thereof, and then injecting the material through the pierced wall.

Some of the objects having been stated, other objects will appear as the description proceeds, when taken in connection with the accompanying drawings in which—

Figure 1:
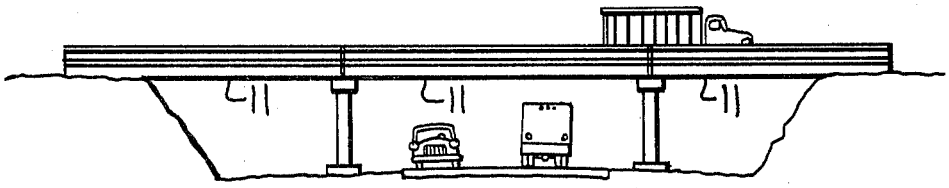
FIG. 1 is an environmental perspective view illustrating a bridge of the type adapted to incorporate an expansion joint and seal.
Figure 2:
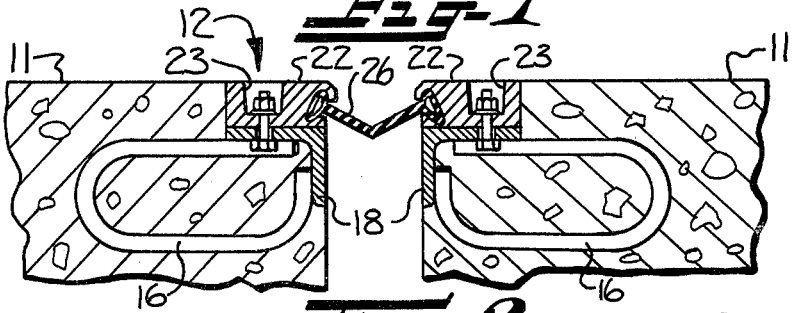
FIG. 2 is a sectional end elevation view of adjacent roadway sections and a joint and seal which embodies the features of the present invention.

Referring more specifically to the drawings, FIG. 1 illustrates a bridge of generally conventional construction, and which comprises a number of roadway sections 11 which are normally interconnected by expansion joints which extend transversely across the roadway. An expansion joint and seal suitable for this use and embodying the features of the present invention is illustrated at 12 in FIGS. 2–4, and will be seen to be mounted so as to close the gap 14 between the roadway sections 11.

In the illustrated embodiment, the adjacent edges of the roadway sections 11 incorporate an internal anchoring framework which is embedded in the concrete, and which comprises a number of steel loops 16 disposed in spaced relation along the edge, and an angle iron 18 secured to the loops 16 by welding or the like. The angle iron 18 is disposed so as to form the bottom wall of a rectangular channel formed in the upper edge of the sections. Also, the angle iron supports a number of bolts 20 which extend upwardly into the channel at longitudinally spaced locations along its length.

A longitudinally extending side rail 22 is disposed within the channel of each of the roadway sections, and overlies and covers the associated angle iron 18. The side rails 22 are preferably fabricated from a suitable metallic material, such as extruded aluminum, and they include a number of vertical openings 23 which are positioned to receive the bolts 20, whereby the rails are firmly secured within the channels and thus to the roadway sections. The side rails 22 further include inner opposing faces, and a socket 24 of generally C-shaped cross-sectional configuration (note FIG. 4) is formed in the opposing faces and extends along the length of the rail.

An elastomeric membrane 26 extends longitudinally between the rails, and includes enlarged opposite side edge portions 28 which are mounted within respective C-shaped sockets 24 of the rails. The side edge portions 28 have an outer cross-sectional configuration when unrestrained which closely conforms to the internal cross-sectional configuration of the sockets, and further include an internal cavity 29 extending longitudinally along its length and positioned substantially within the associated socket of the rail. In accordance with the present invention, a relatively incompressible material 30 substantially fills each of the cavities 29 in the opposite side edge portions to thereby substantially resist the compression of the side edge portions 28 and thus the withdrawal thereof from the respective sockets 24.

Figure 3:
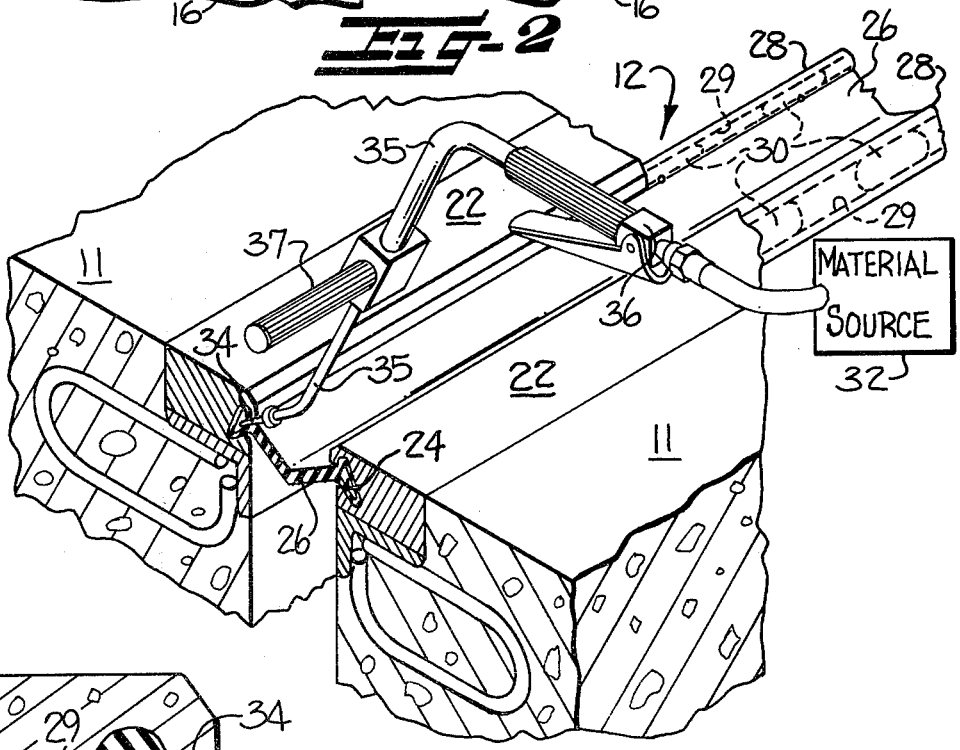
FIG. 3 is a fragmentary perspective view illustrating the method by which the side edge portions of the membrane of the joint and seal is secured within the sockets of the side rails.
Figure 4:
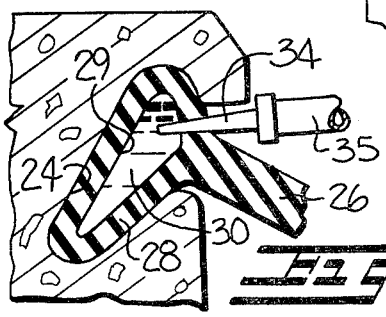
FIG. 4 is an enlarged fragmentary sectional view further illustrating the method of the present invention.

FIGS. 3 and 4 illustrate the method of fabricating the above-described joint and seal in accordance with the present invention. In this regard, the rails 22 are intially secured upon the angle irons 18 in the channels, and a suitable mastic sealant (not shown) may be positioned in the openings 23 to cover the bolts 20. The membrane 26 is then positioned to overlie the gap between the rails, and the side edge portions 28 are coated with a lubricating adhesive. The coated edge portions are then forced laterally into the sockets, preferably by sequentially forcing short segments of the membrane into the socket by hand. During its entry into the socket, the side edge portions 28 are compressed and the cavities 29 collapsed to permit entry through the narrow entrance of the socket. Thereafter, the side edge portions return to substantially their original size and configuration so as to be held behind the narrow entrance of the socket. As an alternative to the above method, the rails 22 and membrane 26 may be initially assembled, and then the resulting assembly mounted along the channels of the concrete roadway sections.

Once the membrane 26 is joined to the rails 22, the relatively incompressible material 30 is injected into the cavities 29 of the side edge portions so as to substantially fill the same. An apparatus for accomplishing this process is schematically illustrated in FIGS. 3 and 4, and includes a pressurized material source 32 which is operatively connected to an injection needle 34 via the hose 35, which has a valve 36 and handle 37 fixed thereto. The needle 34 is designed to pierce the wall of the cavity 29 of each side edge portion at spaced locations along the length thereof, and so that the material 30 may be injected through the pierced wall and into the cavity by the manual opening of the valve 36. Depending upon the distance between the piercing operations, the material 30 may be injected so as to become substantially continuous along the length of the cavities, or the material may be in the form of spaced apart deposits in the immediate vicinity of each pierced aperture in the wall as indicated in FIG. 3. In either case, the entire cross-section of the cavities 29 is filled with the incompressible material along at least portions of the length of the cavities, which effectively prevents the side edge portions from collapsing and withdrawing through the narrow portion of the C-shaped socket. As will be apparent from FIG. 4, the wall of the cavity of each side edge portion includes an upper, generally vertical wall portion which is exposed and directly accessible from the upper side of the joint and seal, and such that the injection needle 34 is able to directly penetrate such wall portion without passing through any other portion of the membrane 26.

The material injected into the cavities may be selected from a number of suitable compositions. For example, a bituminous mastic may be employed, or a suitable plastic resin which foams into a rigid structure could be employed. In certain installations, it may be desirable to utilize a material which is less than totally rigid or incompressible, such as where it is desired to leave open the possibility of removal of a damaged membrane by the application of a large force for replacement purposes.

It will be appreciated that the cross-sectional configuration of the sockets 24 need not be exactly C-shaped, and thus the phrase "generally C-shaped" as used herein in describing the sockets should be broadly construed to include any configuration having a narrow entrance which would act to resist the withdrawal of the side edge portion of the membrane. Thus for example, the socket could be sagittal in cross section.

In the drawings and specification, there has been set forth a preferred embodiment of the invention, and although specific terms are employed, they are used in a generic and descriptive sense only and not for purposes of limitation.

That which is claimed is:

1. In an expansion joint and seal comprising a pair of longitudinally extending side rails disposed in a parallel, laterally spaced apart relationship, said rails having upper surfaces, opposing faces and a socket of generally C-shaped cross-sectional configuration formed in each of the opposing faces and extending along the length of the rails, and an elongate flexible membrane extending longitudinally between the rails and having enlarged opposite side edge portions mounted within respective C-shaped sockets, with said opposite side edge portions each having an internal cavity extending longitudinally along its length and positioned substantially within the associated socket, the improvement wherein each of said side edge portions includes a wall portion which is exposed from the upper side of the joint and seal and such that an injection needle or the like is adapted to directly penetrate said wall portion without passing through any other portion of the membrane, and further comprising a relatively incompressible material substantially filling each of the cavities in said side edge portions to thereby substantially resist the compression of the side edge portions and thus the withdrawal thereof from the respective sockets.

2. The joint and seal as defined in claim 1 wherein the incompressible material fills the entire cross-section of the cavities in said opposite side edge portions along at least portions of the length thereof.

3. The joint and seal as defined in claim 1 or 2 wherein said side edge portions have an outer cross-sectional configuration when unrestrained which closely conforms to the cross-sectional configuration of said sockets.

4. A method of fabricating a roadway expansion joint and seal between adjacent, spaced apart roadway sections, and comprising the steps of assembling an elongate flexible sealing membrane with a pair of elongate, parallel side rails, with the rails having a socket of generally C-shaped cross-sectional configuration in each of their opposing faces and extending along the length thereof, and with the elongate flexible membrane having enlarged opposite side edge portions which are hollow so as to define an internal longitudinal cavity extending therealong, and such that the membrane is disposed between the rails and the opposite side edge portions are mounted within respective ones of the C-shaped sockets, and then injecting a relatively incompressible material into the cavities of the side edge portions so as to substantially fill the cavities and thereby resist the withdrawal of the side edge portions from their respective sockets, and including piercing the wall of the cavity of each side edge portion at spaced locations along the length thereof and injecting the incompressible material through the pierced wall and into the cavity thereof.

5. The method as defined in claim 4 comprising the further step of securing the side rails along respective ones of the adjacent top side edges of adjacent roadway sections, and such that upon completion of the assembling and securing steps the membrane spans the gap between the roadway sections.

6. The method as defined in claim 5 wherein the securing step is performed prior to the assembling step.

7. The method as defined in claim 5 or 6 wherein the assembling step includes compressing the side edge portions while collapsing the cavity therein and laterally inserting the compressed side edge portions into their respective sockets.

8. The method as defined in claim 7 wherein the assembling step further comprises coating the side edge portions of the membrane with a lubricating adhesive prior to inserting the compressed side edge portions into their respective sockets.

9. The method as defined in claim 4 wherein the injecting step includes filling the entire cross-section of the cavities with the incompressible material along at least portions of the length thereof.

* * * * *